US011563265B2

(12) United States Patent
Yang et al.

(10) Patent No.: US 11,563,265 B2
(45) Date of Patent: Jan. 24, 2023

(54) ANTENNA MODULE AND METHOD FOR MANUFACTURING THE SAME

(71) Applicants: QING DING PRECISION ELECTRONICS (HUAIAN) CO., LTD, Huai an (CN); Avary Holding (Shenzhen) Co., Limited., Shenzhen (CN)

(72) Inventors: Yong-Quan Yang, Qinhuangdao (CN); Wei-Tao Ye, Shenzhen (CN)

(73) Assignees: QING DING PRECISION ELECTRONICS (HUAIAN) CO., LTD, Huai an (CN); Avary Holding (Shenzhen) Co., Limited., Shenzhen (CN)

( * ) Notice: Subject to any disclaimer, the term of this patent is extended or adjusted under 35 U.S.C. 154(b) by 375 days.

(21) Appl. No.: 16/556,622

(22) Filed: Aug. 30, 2019

(65) Prior Publication Data

US 2021/0036416 A1 Feb. 4, 2021

(30) Foreign Application Priority Data

Jul. 31, 2019 (CN) ..... 201910698354.0

(51) Int. Cl.
*H01Q 1/42* (2006.01)
*H01Q 1/24* (2006.01)
*H01Q 1/36* (2006.01)

(52) U.S. Cl.
CPC ..... *H01Q 1/42* (2013.01); *H01Q 1/24* (2013.01); *H01Q 1/36* (2013.01)

(58) Field of Classification Search
CPC .. H01Q 1/42; H01Q 1/24; H01Q 1/36; H01Q 1/2283; H01Q 1/38; H01Q 1/50
See application file for complete search history.

(56) References Cited

U.S. PATENT DOCUMENTS

2009/0061721 A1* 3/2009 Isa ..... H01L 27/1266 445/24
2017/0133288 A1* 5/2017 Baek ..... H01L 21/565
2017/0213794 A1* 7/2017 Baek ..... H01L 23/5386
2017/0271272 A1* 9/2017 Lee ..... H01L 21/486
2018/0053036 A1* 2/2018 Baek ..... H01L 21/561
2018/0265349 A1* 9/2018 Ito ..... B81B 7/0058

* cited by examiner

*Primary Examiner* — Minh D A
(74) *Attorney, Agent, or Firm* — ScienBiziP, P.C.

(57) ABSTRACT

An antenna module includes an inner circuit board, an antenna circuit board, an outer circuit board, and at least one chip. The inner circuit board includes at least one inner wiring layer and at least one inner dielectric layer. The antenna circuit board includes at least one antenna structure. The antenna circuit board and the outer circuit board are disposed on opposite sides of the inner circuit board. The inner wiring layer comprises at least one inner pad. At least one first opening passing through the outer circuit board is defined to expose the inner pad. Each chip is received in one first opening and electrically connects to the inner pad. The antenna structure electrically connects to the chip through the inner wiring layer. A method for manufacturing such antenna module is also provided.

18 Claims, 11 Drawing Sheets

ANTENNA MODULE AND METHOD FOR MANUFACTURING THE SAME

FIELD

The subject matter herein generally relates to an antenna module and a method for manufacturing the antenna module.

BACKGROUND

With the development of the 5th generation wireless systems, more components need to be integrated in the antenna module. This would result in an increase in a size of the antenna module at a time when devices for the wireless system are becoming smaller.

Therefore, there is room for improvement within the art.

BRIEF DESCRIPTION OF THE DRAWINGS

Implementations of the present disclosure will now be described, by way of embodiments, with reference to the attached figures.

DETAILED DESCRIPTION

Figure 1:
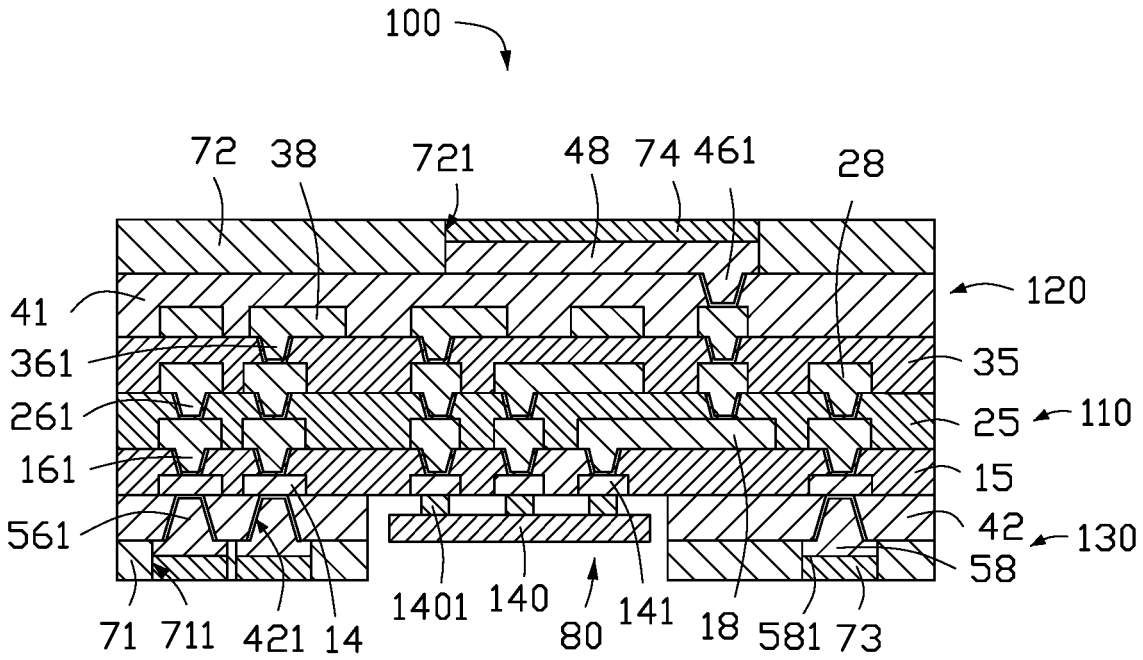
FIG. 1 is a cross-sectional view of an embodiment of an antenna module.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series, and the like.

FIG. 1 illustrates an embodiment of an antenna module 100. The antenna module 100 includes an inner circuit board 110, an antenna circuit board 120, an outer circuit board 130, and at least one chip 140. The antenna circuit board 120 and the outer circuit board 130 are respectively disposed on opposite sides of the inner circuit board 110. The chip 140 is received in the outer circuit board 130. The inner circuit board 110 includes at least one inner dielectric layer and at least one inner wiring layer. Where there are multiple inner dielectric layers and multiple inner wiring layers they are arranged alternately. The antenna circuit board 120 includes at least one antenna structure 48. Each antenna structure 48 electrically connects to the chip 140 through the inner wiring layer of the inner circuit board 110.

In at least one embodiment, each antenna structure 48 may be sheet-like or circular. In another embodiment, a shape of each antenna structure 48 may be varied as needed. Specifically, each antenna structure 48 may be a patch antenna, a vibrator antenna, a slot antenna, an F-type antenna, a dipole antenna, or a Yagi antenna, to correspond to different frequency bands or different frequency band combinations.

In at least one embodiment, the inner circuit board 110 includes a first inner wiring layer 14, a first inner dielectric layer 15 covering the first inner wiring layer 14, a second inner wiring layer 18 on the first inner dielectric layer 15, a second inner dielectric layer 25 covering the second inner wiring layer 18, a third inner wiring layer 28 on the second inner dielectric layer 25, a third inner dielectric layer 35 covering the third inner wiring layer 28, and a fourth inner wiring layer 38 on the third inner dielectric layer 35. The first inner wiring layer 14 includes at least one inner pad 141. The inner pad 141 is buried in the first inner dielectric layer 15, and a surface of the inner pad 141 facing away from the second inner wiring layer 18 is exposed from the first inner dielectric layer 15. The first inner wiring layer 14 electrically connects to the second inner wiring layer 18 through at least one first inner conductive via 161. The second inner wiring layer 18 electrically connects to the third inner wiring layer 28 through at least one second inner conductive via 261. The third inner wiring layer 28 electrically connects to the fourth inner wiring layer 38 through at least one third inner conductive via 361.

In at least one embodiment, the first inner conductive via 161 is buried in the first inner dielectric layer 15, the second inner conductive via 261 is buried in the second inner dielectric layer 25, and the third inner conductive via 361 is buried in the third inner dielectric layer 35.

The second inner dielectric layer 25 fills in gaps of the second inner wiring layer 18 so as to be in contact with the first inner dielectric layer 15. The third inner dielectric layer 35 fills in gaps of the third inner wiring layer 28 so as to be in contact with the second inner dielectric layer 25.

The antenna structure 48 electrically connects to the fourth inner wiring layer 38 through at least one antenna connecting structure 461, and the chip 140 electrically connects to the first inner wiring layer 14, thereby achieving an electrical connection between the chip 140 and the antenna structure 48.

In at least one embodiment, the antenna circuit board 120 may further include an antenna dielectric layer 41 covering the fourth inner wiring layer 38 and filling in gaps of the fourth inner wiring layer 38 so as to be in contact with the third inner dielectric layer 35. The antenna connecting structure 461 is buried in the antenna dielectric layer 41.

In at least one embodiment, the antenna circuit board 120 may further include a second solder mask 72 on the antenna dielectric layer 41. At least one third opening 721 passing through the second solder mask 72 is defined. The antenna structure 48 is exposed from the third opening 721.

In at least one embodiment, the antenna circuit board 120 may further include a second antioxidant layer 74 on the antenna structure 48 to protect the antenna structure 48. The second antioxidant layer 74 may be a nickel-gold alloy layer formed by Electroless Nickel/Immersion Gold.

In at least one embodiment, the outer circuit board 130 includes an outer dielectric layer 42 covering the first inner dielectric layer 15, an outer wiring layer 58 on the outer dielectric layer 42, and a first solder mask 71 covering the outer dielectric layer 42. The outer wiring layer 58 includes at least one first soldering pad 581 to electrically connect to a circuit board (not shown). At least one second opening 711 is defined on the first solder mask 71 to expose the first soldering pad 581.

The outer dielectric layer 42 is in contact with the first inner dielectric layer 15.

The outer wiring layer 58 electrically connects to the first inner wiring layer 14 through at least one outer conductive via 561. The outer conductive via 561 is buried in the outer dielectric layer 42.

In at least one embodiment, the outer circuit board 130 may further include a first antioxidant layer 73 formed on the first soldering pad 581 to protect the first soldering pad 581. The first antioxidant layer 73 may be a nickel-gold alloy layer of paragraph [0033].

In at least one embodiment, each chip 140 includes at least one pin 1401 to electrically connect to the first inner wiring layer 14. In at least one embodiment, a size of each first soldering pad 581 is greater than a size of each inner pad 141 to ensure reliability of the outer wiring layer 58 when subsequently soldered to the circuit board.

In at least one embodiment, each of the first inner dielectric layer 15, the second inner dielectric layer 25, the third inner dielectric layer 35, the outer dielectric layer 42, and the antenna dielectric layer 41 has a dielectric constant $D_k$ of less than 3 and a dielectric loss $D_f$ of less than 0.2, to ensure quality of high-frequency signal transmission.

Figure 2:
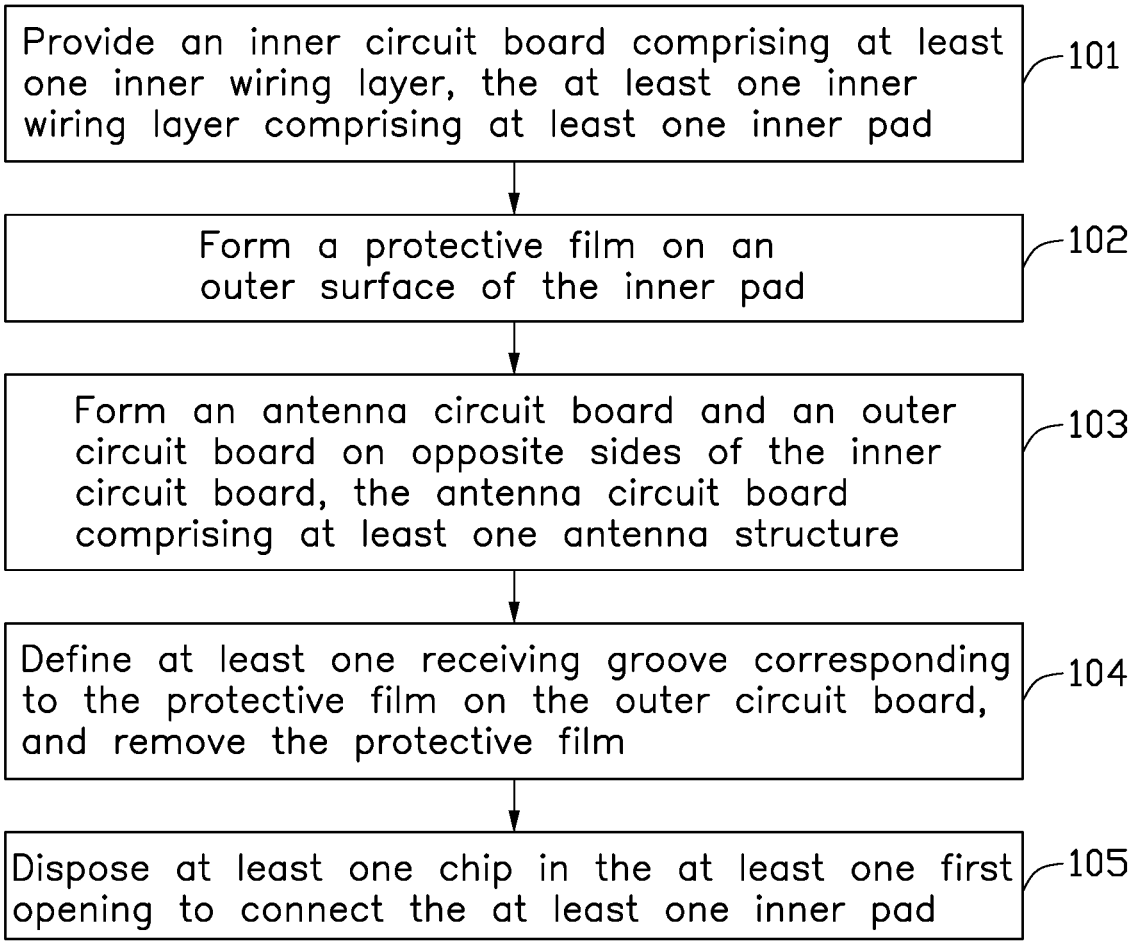
FIG. 2 is a flowchart of an embodiment of a method for manufacturing an antenna module.

FIG. 2 illustrates a flowchart of a method in accordance with an embodiment. The method for manufacturing an antenna module 100 (shown in FIG. 1) is provided by way of embodiments, as there are a variety of ways to carry out the method. Each block shown in FIG. 2 represents one or more processes, methods, or subroutines carried out in the method. Furthermore, the illustrated order of blocks can be changed. Additional blocks may be added or fewer blocks may be utilized, without departing from this disclosure. The method can begin at block 101.

Figure 3:
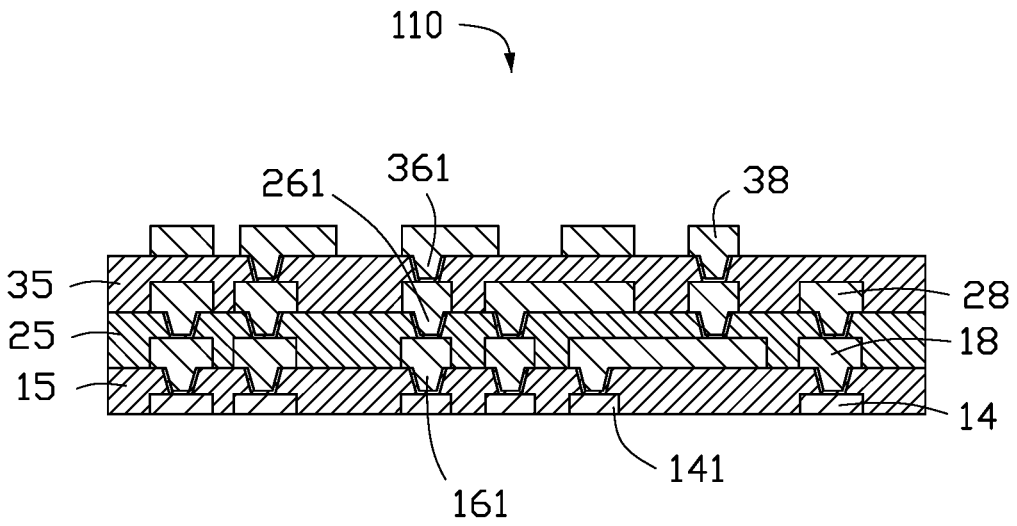
FIG. 3 is a cross-sectional view of an embodiment of an inner circuit board.

At block 101, referring to FIG. 3, an inner circuit board 110 is provided. The circuit substrate 110 includes at least one inner wiring layer and at least one inner dielectric layer. The inner wiring layer includes at least one inner pad 141.

Figure 4:
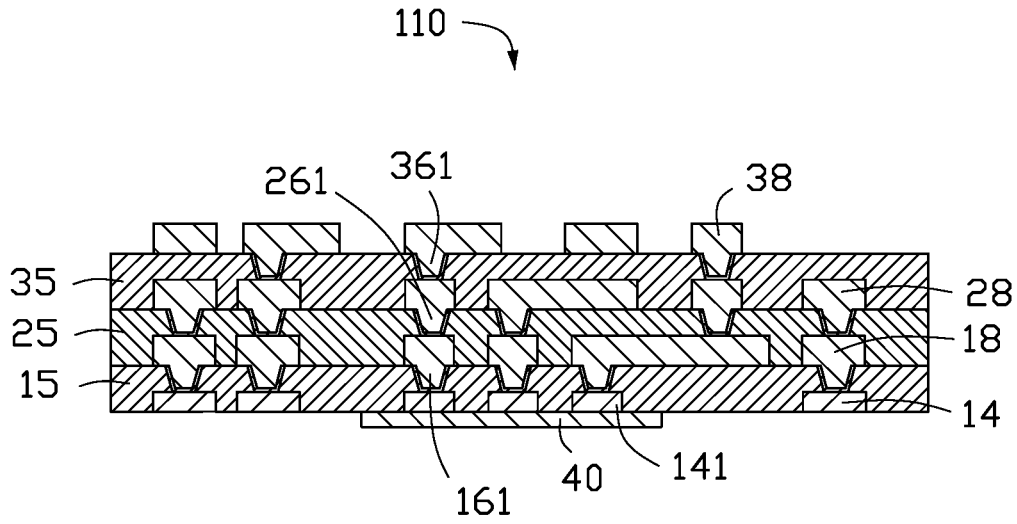
FIG. 4 is a cross-sectional view showing a protective film on the inner circuit board of FIG. 3.

At block 102, referring to FIG. 4, a protective film 40 is formed on an outer surface of the inner pad 141 to cover the inner pad 141.

In at least one embodiment, the protective film 40 may be a releasable film.

Figure 5:
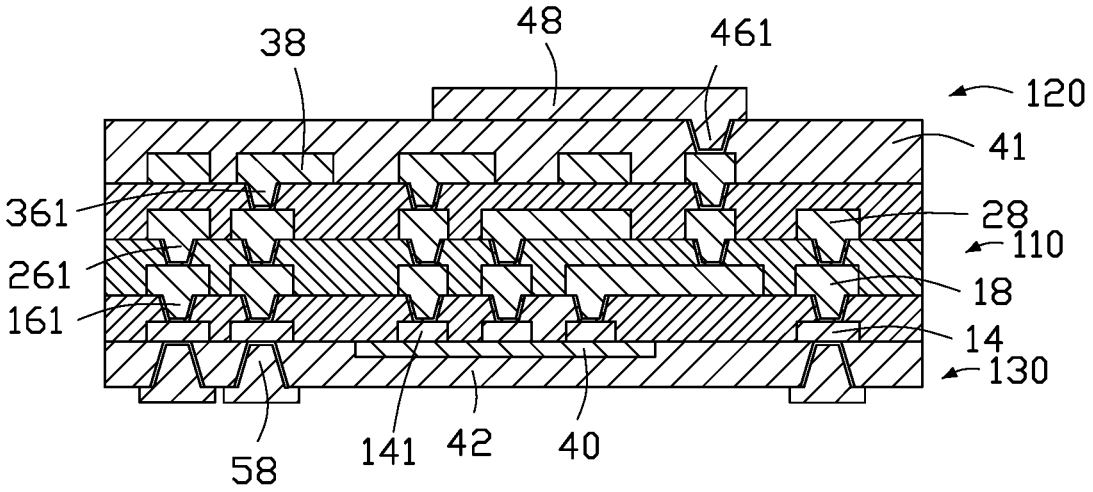
FIG. 5 is a cross-sectional view showing an antenna circuit board and an outer circuit board on the inner circuit board of FIG. 4.

At block 103, referring to FIG. 5, an antenna circuit board 120 and an outer circuit board 130 are respectively formed on opposite sides of the inner circuit board 110. The antenna circuit board 120 includes at least one antenna structure 48 electrically connect to a side of the inner wiring layer facing away from the inner pad 141.

Figure 6:
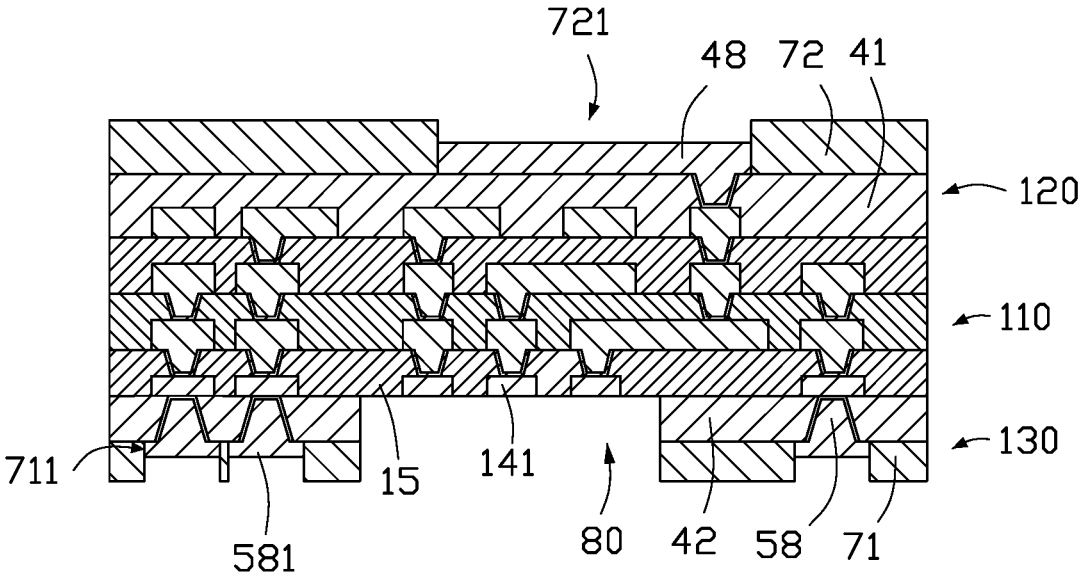
FIG. 6 is a cross-sectional view showing at least one inner pad exposed from an antenna circuit board.

At block 104, referring to FIG. 6, at least one first opening 80 corresponding to the protective film 40 is defined on the outer circuit board 130 to expose the protective film 40, and the protective film 40 is removed to expose the inner pad 141.

At block 105, referring to FIG. 1, at least one chip 140 is received in the first opening 80 and connects to the inner pad 141 to obtain the antenna module 100. In the antenna module 100, the chip 140 electrically connects to the antenna structure 48 through the inner wiring layer of the inner circuit board 110.

In at least one embodiment, a thickness of each chip 140 is less than a thickness of the outer circuit board 130.

In at least one embodiment, the chip 140 includes at least one pin 1401 to connect to the inner pad 141.

Figure 7:
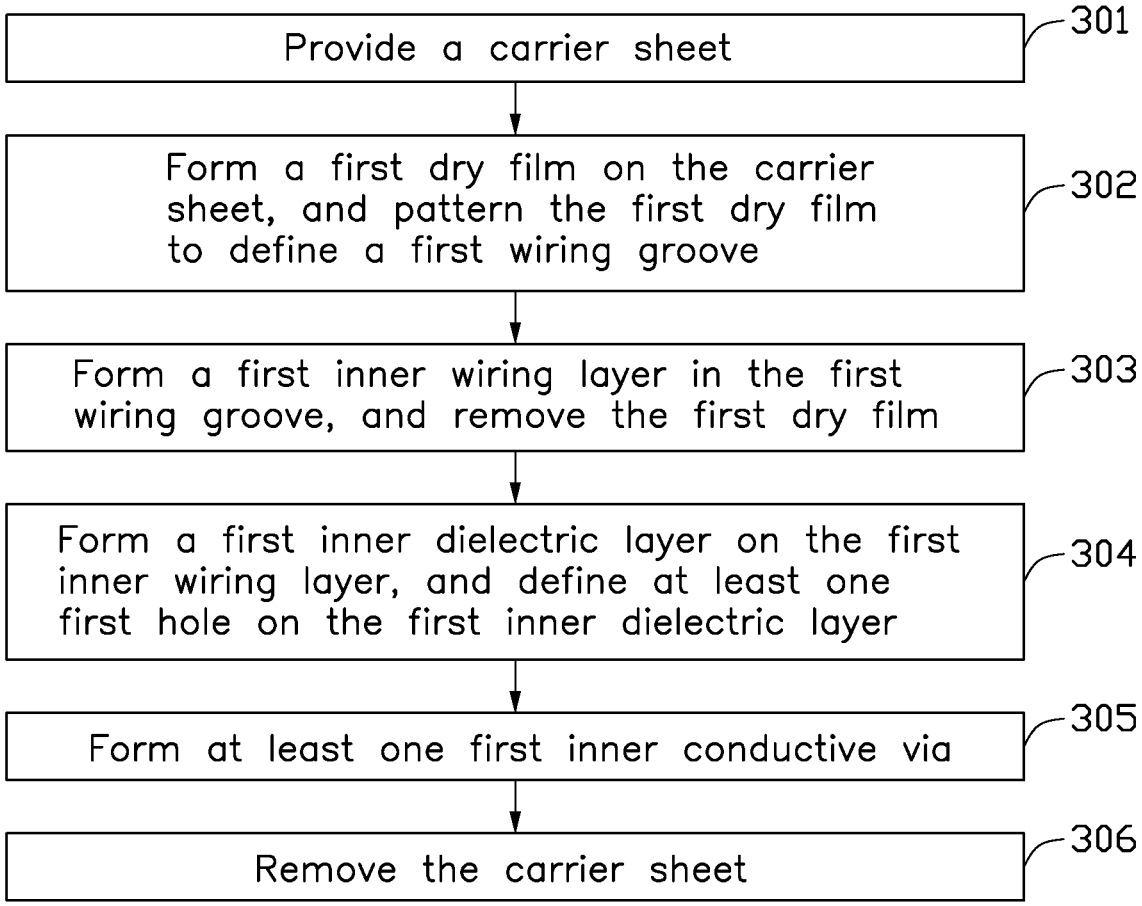
FIG. 7 is a flowchart of an embodiment of a method for manufacturing an inner circuit board.

FIG. 7 illustrates a flowchart of an embodiment of a method for manufacturing the inner circuit board 110. The method can begin at block 301.

Figure 8:
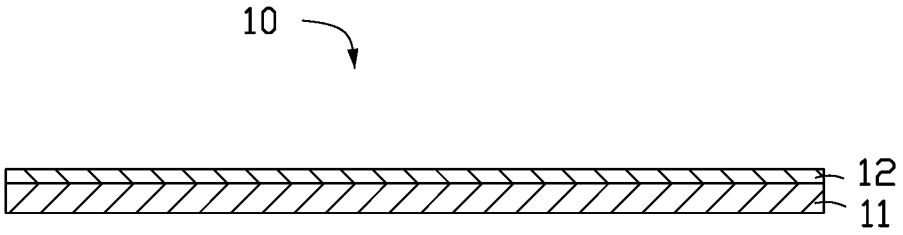
FIG. 8 is a cross-sectional view of an embodiment of a carrier sheet.

At block 301, referring to FIG. 8, a carrier sheet 10 is provided.

In at least one embodiment, the carrier sheet 10 includes a carrier 11 and a seed layer 12 deposited on a surface of the carrier 11. The seed layer 12 is made of a conductive material, such as metal.

In another embodiment, the seed layer 12 may be omitted. The carrier 11 can be a conductive plate.

Figure 9:
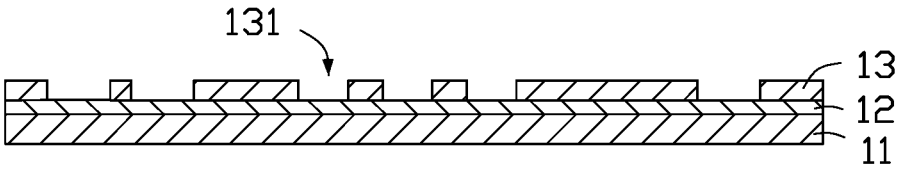
FIG. 9 is a cross-sectional view showing a first dry film on the carrier sheet of FIG. 8.

At block 302, referring to FIG. 9, a first dry film 13 is formed on a surface of the carrier sheet 10, patterned to define a first wiring groove 131.

In at least one embodiment, the first wiring groove 131 may be defined by exposure and development.

In the illustrated embodiment, the first dry film 13 is formed on the seed layer 12 facing away from the carrier 11.

Figure 10:
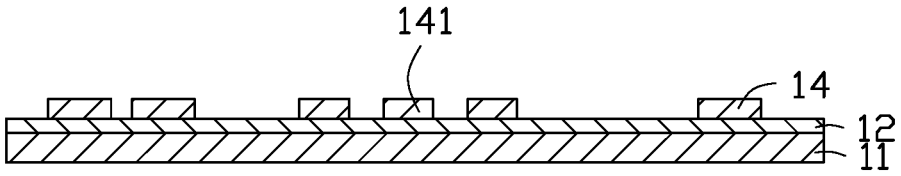
FIG. 10 is a cross-sectional view showing a first inner wiring layer on the carrier sheet of FIG. 9.

At block 303, referring to FIG. 10, a first inner wiring layer 14 corresponding to the first wiring groove 131 is formed on the carrier sheet 10, and the patterned first dry film 13 is removed. The first inner wiring layer 14 includes at least one inner pad 141.

In at least one embodiment, the first inner wiring layer 14 may be formed by electroplating.

Figure 11:
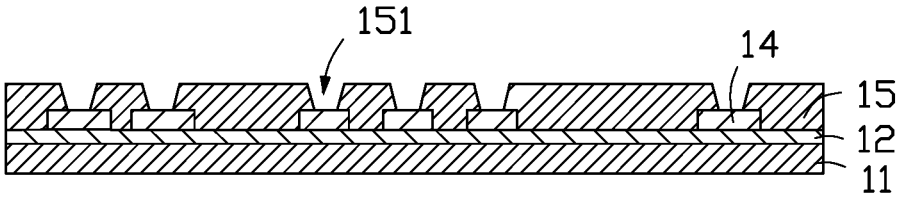
FIG. 11 is a cross-sectional view showing a first inner dielectric layer on the first inner wiring layer of FIG. 10.

At block 304, referring to FIG. 11, a first inner dielectric layer 15 is formed on the first inner wiring layer 14, and at least one first hole 151 is defined on the first inner dielectric layer 15 to expose a portion of the first inner wiring layer 14.

In at least one embodiment, the first inner wiring layer 14 is embedded in the first inner dielectric layer 15. The first inner dielectric layer 15 covers the first inner wiring layer 14 and fills in gaps of the first inner wiring layer 14.

Figure 12:
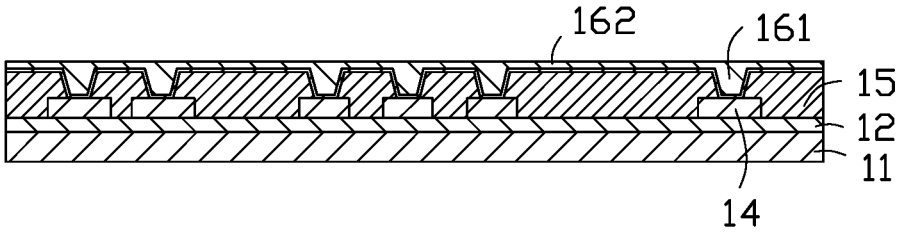
FIG. 12 is a cross-sectional view showing at least one first inner conductive via in the first inner dielectric layer of FIG. 11.

At block 305, referring to FIG. 12, at least one first inner conductive via 161 is formed in the first hole 151.

In at least one embodiment, the first inner conductive via 161 is formed by electroplating.

The first inner conductive via 161 is buried in the first inner dielectric layer 15.

At block 306, referring to FIG. 3, the carrier sheet 10 is removed to obtain the inner circuit board 110.

Figure 13:
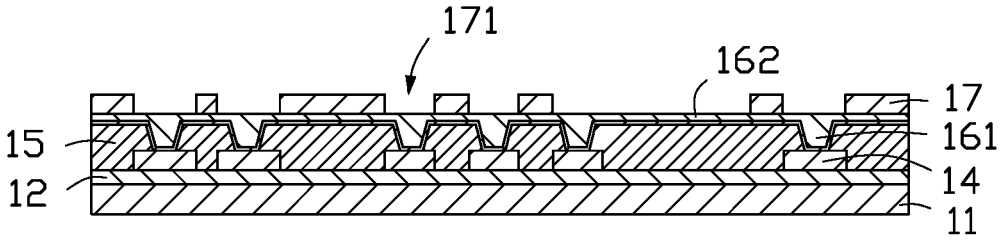
FIG. 13 is a cross-sectional view showing a second dry film on the first inner dielectric layer of FIG. 12.
Figure 14:
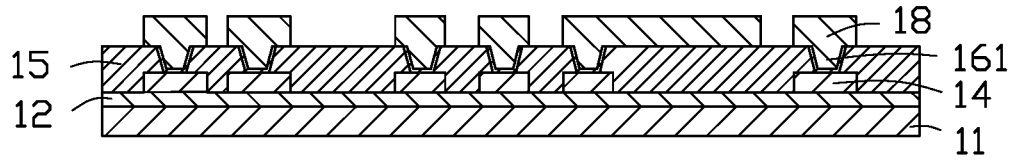
FIG. 14 is a cross-sectional view showing a second inner wiring layer on the first inner dielectric layer of FIG. 13.
Figure 15:
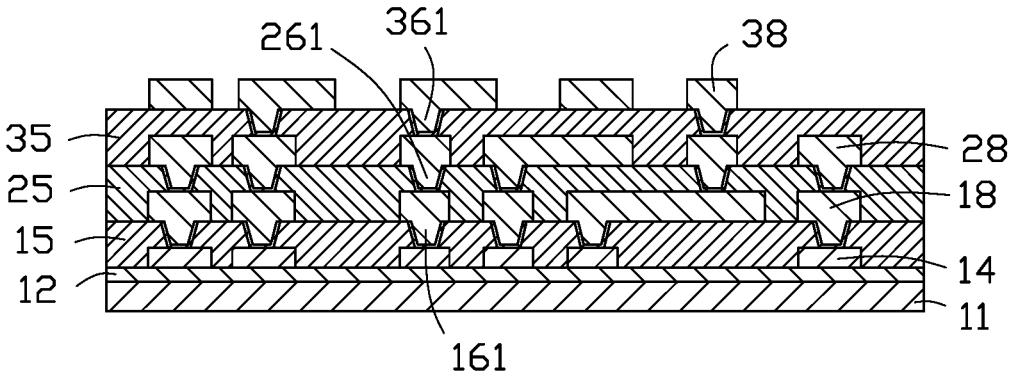
FIG. 15 is a cross-sectional view showing a second inner dielectric layer, a third inner wiring layer, a third inner dielectric layer, and a third inner dielectric layer on the second inner wiring layer of FIG. 14.

In at least one embodiment, at block 305, referring to FIG. 12, a first plating layer 162 is formed on a surface of the first inner dielectric layer 15 facing away from the first inner wiring layer 14 when the first inner conductive via 161 is formed. Before block 306, referring to FIGS. 13, 14 and 15, the method for manufacturing the inner circuit board can repeat blocks 302, 303, 304, and 305 to form a second inner wiring layer 18 on the first inner dielectric layer 15, and a second inner dielectric layer 25 covering the second inner wiring layer 18. Further, a third inner wiring layer 28 can be formed on the second inner dielectric layer 25, a third inner dielectric layer 35 to cover the third inner wiring layer 28, and a fourth inner wiring layer 38 can be formed on a third inner dielectric layer 35. The first inner wiring layer 14 electrically connects to the second inner wiring layer 18 through the first inner conductive via 261. The second inner wiring layer 18 electrically connects to the third inner wiring layer 28 through at least one second inner conductive via 261. The third inner wiring layer 28 electrically connects to the fourth inner wiring layer 38 through at least one third inner conductive via 361.

In at least one embodiment, the second inner conductive via 261 is buried in the second inner dielectric layer 25, and the third inner conductive via 361 is buried in the third inner dielectric layer 35.

The second inner dielectric layer 25 fills in gaps of the second inner wiring layer 18 so as to be in contact with the first inner dielectric layer 15. The third inner dielectric layer 35 fills in gaps of the third inner wiring layer 28 so as to be in contact with the second inner dielectric layer 25.

Figure 16:
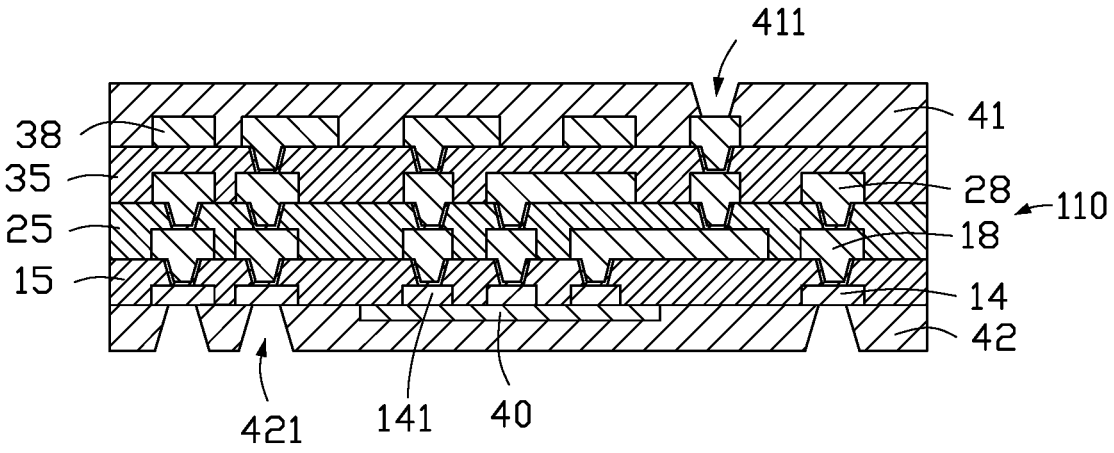
FIG. 16 is a cross-sectional view showing an antenna dielectric layer and an outer dielectric layer on the inner circuit board of FIG. 3.
Figure 17:
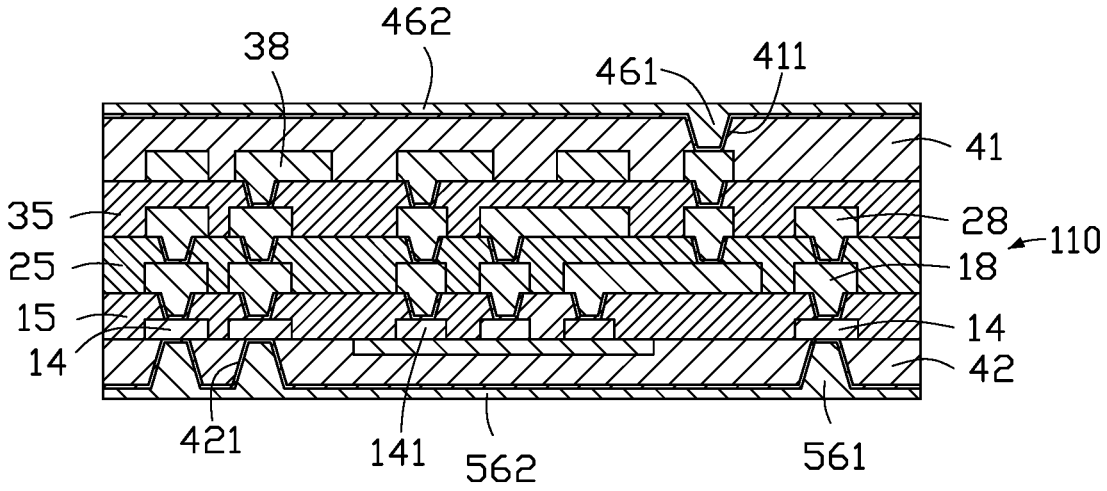
FIG. 17 is a cross-sectional view showing at least one antenna connecting structure, a second plating layer, at least one outer conductive via, and a third plating layer on the inner circuit board of FIG. 16.
Figure 18:
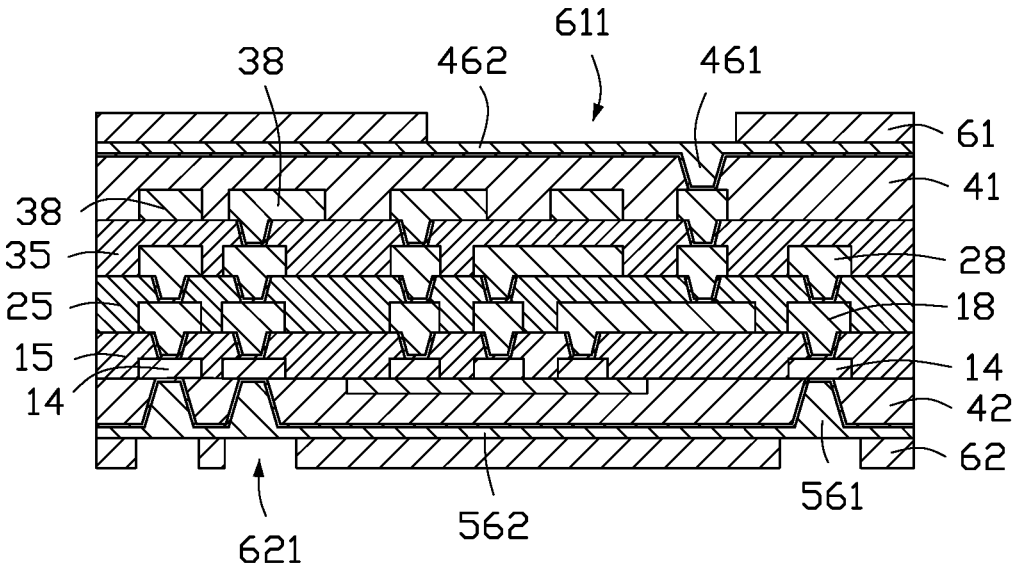
FIG. 18 is a cross-sectional view showing a third dry film and a fourth dry film respectively on the second plating layer and the third plating layer of FIG. 17.

In at least one embodiment, the antenna circuit board 120 and the outer circuit board 130 may be formed by the following steps:

referring to FIG. 16, forming an antenna dielectric layer 41 and an outer dielectric layer 42 on opposite sides of the inner circuit board 110, and defining at least one second hole 411 on the antenna dielectric layer 41 and at least one third hole 421 on the outer dielectric layer 42, to expose a portion of the inner wiring layer of the inner circuit board 110; wherein the antenna dielectric layer 41 is disposed on the side of the inner circuit board 110 facing away from the inner pad 141;

referring to FIG. 17, forming at least one antenna connecting structure 461 in the second hole 411 and a second plating layer 462 on a surface of the antenna dielectric layer 41 facing away from the inner circuit board 110, and forming at least one outer conductive via 561 in the third hole 421 and a third plating layer 562 on a surface of the outer dielectric layer 42 facing away from the inner circuit board 110;

referring to FIG. 18, forming a third dry film 61 on the second plating layer 462 and patterning the third dry film 61 to define a third wiring groove 611, and forming a fourth dry film 62 on the third plating layer 562 and patterning the fourth dry film 62 to define a fourth wiring groove 621;

referring to FIG. 5, forming at least one antenna structure 48 in the third wiring groove 611, forming an outer wiring layer 58 in the fourth wiring groove 621, and removing the patterned third dry film 61 and the patterned fourth dry film 62 referring to FIG. 6, forming a first solder mask 71 on the outer dielectric layer 42 and the outer wiring layer 58, forming a second solder mask 72 on the antenna dielectric layer 41 and the antenna structure 48, and defining at least one second opening 711 to expose a portion of the outer wiring layer 58, and defining at least one third opening 721 to expose the antenna structure 48, wherein the exposed portion of the outer wiring layer 58 acts as at least one first soldering pad 581;

referring to FIG. 1 forming a first antioxidant layer 73 on the first soldering pad 581, and forming a second antioxidant layer 74 on the antenna structure 48.

In at least one embodiment, a size of each first soldering pad 581 is greater than a size of each inner pad 141 to ensure reliability of the outer wiring layer 58 during subsequent soldering to the circuit board.

Depending on the embodiment, certain of the steps of methods described may be removed, others may be added, and the sequence of steps may be altered. It is also to be understood that the description and the claims drawn to a method may include some indication in reference to sequential steps. However, the indication used is only to be viewed for identification purposes and not as a suggestion as to an order for the steps.

In the method for manufacturing the antenna module 100, the chip 140 is embedded in the outer circuit board 130, thereby not only reducing the overall thickness of the antenna module 100, but also protecting the chip from collision with other elements.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. An antenna module comprising:

an inner circuit board comprising at least one inner wiring layer and at least one inner dielectric layer;

an antenna circuit board comprising at least one antenna structure and an antenna dielectric layer formed between the inner circuit board and the at least one antenna structure;

an outer circuit board; and at least one chip;

wherein the antenna circuit board and the outer circuit board are disposed on opposite sides of the inner circuit board; the at least one inner wiring layer comprises at least one inner pad, at least one first opening passing through the outer circuit board is defined to expose the at least one inner pad; each of the at least one chip is received in one of the at least one first opening and electrically connects to the at least one inner pad, the at least one antenna structure electrically connects to the chip through the at least one inner wiring layer;

wherein each of the at least one inner dielectric layer and the antenna dielectric layer has a dielectric constant of less than 3 and a dielectric loss of less than 0.2.

2. The antenna module of claim 1, wherein the outer circuit board comprises an outer dielectric layer formed on the inner circuit board and an outer wiring layer formed on the outer dielectric layer facing away from the inner circuit board; the outer wiring layer electrically connects to the at least one inner wiring layer; each of the at least one first opening passes through the outer dielectric layer and the outer wiring layer.

3. The antenna module of claim 2, wherein the outer circuit board further comprises a first solder mask formed on the outer wiring layer facing away from the outer dielectric layer, each of the at least one first opening further passes through the first solder mask.

4. The antenna module of claim 3, wherein a thickness of each of the chip is less than a total thickness of the outer dielectric layer, the outer wiring layer and the first solder mask.

5. The antenna module of claim 3, wherein the outer wiring layer comprises at least one first soldering pad, at least one second opening is defined on the first solder mask to expose the at least one first soldering pad; a size of each of the first soldering pad is greater than a size of each of the inner pad.

6. The antenna module of claim 5, wherein a first antioxidant layer is disposed on a surface of the at least one first soldering pad facing away from the inner circuit board.

7. The antenna module of claim 1, wherein the antenna circuit board further comprises a second solder mask formed on the antenna dielectric layer.

8. The antenna module of claim 7, wherein at least one third opening is defined on the second solder mask to expose the at least one antenna structure.

9. The antenna module of claim 1, wherein a second antioxidant layer is disposed on a surface of the antenna structure facing away from the inner circuit board.

10. The antenna module of claim 1, wherein the at least one inner pad is embedded in the at least one inner dielectric layer.

11. A method for manufacturing an antenna module comprising:

providing an inner circuit board comprising at least one inner wiring layer and at least one inner dielectric layer, the at least one inner wiring layer comprising at least one inner pad exposed from the at least one inner dielectric layer;

forming an antenna circuit board and an outer circuit board on opposite sides of the inner circuit board, the antenna circuit board comprising at least one antenna structure electrically connecting to a side of the inner wiring layer facing away from the at least one inner pad and an antenna dielectric layer formed between the inner circuit board and the at least one antenna structure;

defining at least one first opening on the outer circuit board to expose the at least one inner pad; and disposing at least one chip in the at least one first opening to connect to the at least one inner pad, the chip electrically connecting to the antenna structure through the least one inner wiring layer;

wherein each of the at least one inner dielectric layer and the antenna dielectric layer has a dielectric constant of less than 3 and a dielectric loss of less than 0.2.

12. The method for manufacturing an antenna module of claim 11, wherein the outer circuit board comprises an outer dielectric layer formed on the inner circuit board and an outer wiring layer formed on the outer dielectric layer facing away from the inner circuit board; the outer wiring layer electrically connects to the at least one inner wiring layer; each of the at least one first opening passes through the outer dielectric layer and the outer wiring layer.

13. The method for manufacturing an antenna module of claim 12, wherein the outer circuit board further comprises a first solder mask formed on the outer wiring layer facing away from the outer dielectric layer, each of the at least one first opening further passes through the first solder mask.

14. The method for manufacturing an antenna module of claim 13, wherein a thickness of each of the chip is less than a total thickness of the outer dielectric layer, the outer wiring layer and the first solder mask.

15. The method for manufacturing an antenna module of claim 13, wherein the outer wiring layer comprises at least one first soldering pad, at least one second opening is defined on the first solder mask to expose the at least one first soldering pad; a size of each of the first soldering pad is greater than a size of each of the inner pad; a first antioxidant layer is disposed on a surface of the at least one first soldering pad facing away from the inner circuit board.

16. The method for manufacturing an antenna module of claim 11, wherein the antenna circuit board further comprises a second solder mask formed on the antenna dielectric layer, at least one third opening is defined on the second solder mask to expose the at least one antenna structure.

17. The method for manufacturing an antenna module of claim 11, wherein a second antioxidant layer is disposed on a surface of the antenna structure facing away from the inner circuit board.

18. The method for manufacturing an antenna module of claim 11, wherein the at least one inner pad is embedded in the at least one inner dielectric layer.

* * * * *